US009340010B2

(12) United States Patent
Gejima

(10) Patent No.: US 9,340,010 B2
(45) Date of Patent: May 17, 2016

(54) LIQUID DISCHARGE HEAD AND RECORDING DEVICE USING SAME

(71) Applicant: KYOCERA Corporation, Kyoto-shi, Kyoto (JP)

(72) Inventor: Kenko Gejima, Kirishima (JP)

(73) Assignee: KYOCERA CORPORATION, Kyoto-Shi, Kyoto (JP)

( * ) Notice: Subject to any disclaimer, the term of this patent is extended or adjusted under 35 U.S.C. 154(b) by 0 days.

(21) Appl. No.: 14/779,597

(22) PCT Filed: Mar. 18, 2014

(86) PCT No.: PCT/JP2014/057327

§ 371 (c)(1),
(2) Date: Sep. 24, 2015

(87) PCT Pub. No.: WO2014/156829

PCT Pub. Date: Oct. 2, 2014

(65) Prior Publication Data

US 2016/0052262 A1 Feb. 25, 2016

(30) Foreign Application Priority Data

Mar. 26, 2013 (JP) ..... 2013-064300

(51) Int. Cl.
*B41J 2/045* (2006.01)

(52) U.S. Cl.
CPC ..... *B41J 2/04541* (2013.01); *B41J 2/04586* (2013.01)

(58) Field of Classification Search
CPC .... B41J 2/04541; B41J 2/045; B41J 2/04586; B41J 2/04548; B41J 2/14072
USPC ..... 347/50
See application file for complete search history.

(56) References Cited

U.S. PATENT DOCUMENTS 7,900,328 B2 * 3/2011 Suzawa ..... B41J 2/14274 29/25.35
2007/0042613 A1 2/2007 Yoda
2009/0071004 A1 3/2009 Suzawa et al.

FOREIGN PATENT DOCUMENTS

JP 2007-050638 A 3/2007
JP 2009-066976 A 4/2009
JP 2010-052256 A 3/2010

OTHER PUBLICATIONS

International Search Report, PCT/JP2014/057327, Apr. 22, 2014, 1 pg.

* cited by examiner

*Primary Examiner* — Alessandro Amari
*Assistant Examiner* — Michael Konczal
(74) *Attorney, Agent, or Firm* — Volpe and Koenig, P.C.

(57) ABSTRACT

An object of the present invention is to provide a liquid discharge head in which a driver IC is not easily damaged at the time of assembling, and a recording device using the same. A liquid discharge head of the present invention is the liquid discharge head including a head main body, a casing, and a driver IC that drives the head main body. The casing has an opening and is in contact with the head main body at the opening so as to cover at least a part of the head main body, a part of an inner surface of a side plate of the casing continuing from the opening has an inclination portion inclined toward the inner side of the casing with respect to the opening, and the driver IC is in contact with the inclination portion of the inner surface.

10 Claims, 8 Drawing Sheets

LIQUID DISCHARGE HEAD AND RECORDING DEVICE USING SAME

TECHNICAL FIELD

The present invention relates to a liquid discharge head that discharges liquid droplets and a recording device using the same.

BACKGROUND ART

As a head main body of a liquid discharge head used for inkjet type printing, there is a known head main body formed by laminating a flow passage member having a manifold (common flow passage) and a plurality of discharge holes which is respectively connected via a plurality of liquid pressurization chambers from the manifold, and piezoelectric actuator substrates having a plurality of displacement elements which is provided to respectively cover the liquid pressurization chambers (for example, refer to Patent Literature 1). In this head main body, by displacing the displacement elements of the piezoelectric actuator substrates, ink can be discharged from discharge holes. Four piezoelectric actuator substrates are provided, and a flexible substrate is connected to each of the piezoelectric actuator substrates. A driver IC that processes a drive signal is respectively mounted on the flexible substrate. The driver IC is in contact with an inner surface of an oblong casing of the liquid discharge head, and heat of the driver IC is removed through the casing.

PRIOR ART DOCUMENT

Patent Document

Patent Document 1: Japanese Unexamined Patent Publication No. 2010-52256

SUMMARY OF THE INVENTION

Problems to be Solved by the Invention

However, in the liquid discharge head described in Patent Literature 1, at the time of attaching the casing to the head main body, a side plate of the casing is moved to rub the driver IC. Thus, assembling is difficult and there is also a fear that the driver IC is damaged at the time of assembling.

Therefore, an object of the present invention is to provide a liquid discharge head in which a driver IC is not easily damaged at the time of assembling, and a recording device using the same.

Means for Solving the Problems

A liquid discharge head of the present invention is a liquid discharge head including a head main body, a casing, and one or more driver IC that drives the head main body, wherein the casing has an opening, and is connected to the head main body at an edge of the opening so as to cover at least a part of the head main body, a part of an inner surface of a side plate of the casing continuing from the opening has an inclination portion inclined toward the inner side of the casing with respect to the opening, and the driver IC is in contact with the inclination portion of the inner surface.

A recording device of the present invention includes the liquid discharge head, a conveying section that conveys a recording medium to the liquid discharge head, and a control section that controls the head main body.

Effect of the Invention

According to the liquid discharge head of the present invention, at the time of attaching the casing to the head main body, the driver IC is not easily brought into a state where the inner surface of the casing rubs the driver IC. Thus, a possibility that the driver IC is damaged can be reduced.

BRIEF DESCRIPTION OF THE DRAWINGS

FIG. 6(*b*) is a perspective view of a casing.

EMBODIMENTS FOR CARRYING OUT THE INVENTION

Figure 1:
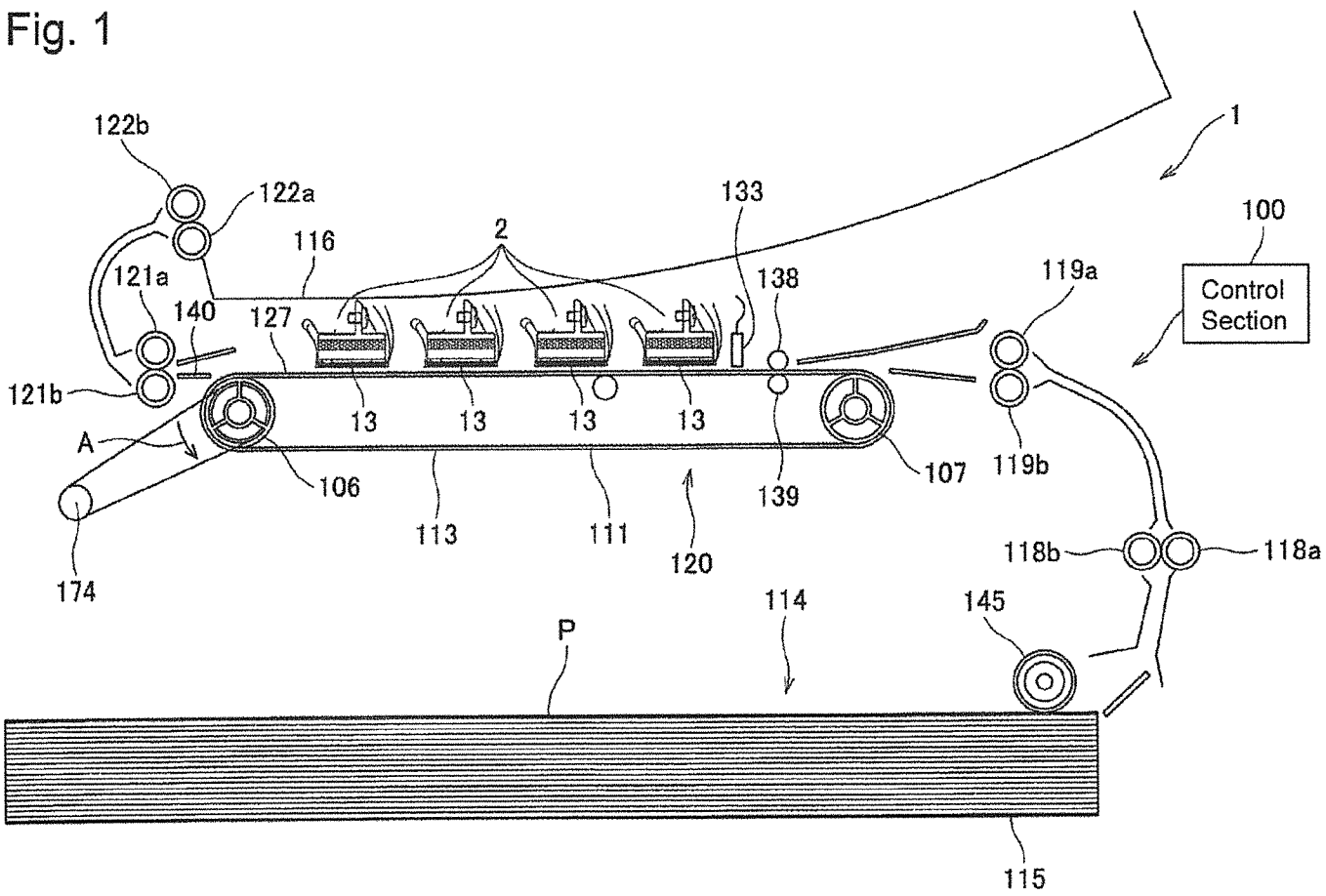
FIG. 1 is a schematic configuration diagram of a printer serving as a recording device according to one embodiment of the present invention.

FIG. 1 is a schematic configuration diagram of a color inkjet printer serving as a recording device which includes liquid discharge heads according to one embodiment of the present invention. This color inkjet printer 1 (hereinafter, referred to as the printer 1) has four liquid discharge heads 2. These liquid discharge heads 2 are aligned along the conveying direction of a printing paper P, and the liquid discharge heads 2 fixed to the printer 1 have a thin and long shape elongated in the direction extending from the near side to the far side of FIG. 1. This elongating direction will sometimes be called as the longitudinal direction.

In the printer 1, a paper feed unit 114, a conveying unit 120, and a paper receiving section 116 are provided in this order along a conveying route of the printing paper P. In the printer 1, a control section 100 for controlling actions in parts of the printer 1 such as the liquid discharge heads 2 and the paper feed unit 114 is also provided.

The paper feed unit 114 has a paper accommodation case 115 capable of accommodating a plurality of the printing papers P, and a paper feed roller 145. The paper feed roller 145 can feed the top printing paper P among the printing papers P laminated and accommodated in the paper accommodation case 115 one by one.

Between the paper feed unit 114 and the conveying unit 120, two pairs of feed rollers 118*a*, 118*b* and 119*a*, 119*b* are arranged along the conveying route of the printing paper P. The printing paper P fed out from the paper feed unit 114 is guided by these feed rollers and further fed to the conveying unit 120.

The conveying unit 120 has an endless conveying belt 111 and two belt rollers 106 and 107. The conveying belt 111 is looped over the belt rollers 106 and 107. The conveying belt 111 is adjusted to have such length that the conveying belt is stretched by predetermined tensile force when looped over the two belt rollers. Thereby, the conveying belt 111 is stretched without slack along two parallel planes respectively including tangent lines shared by the two belt rollers. The plane close to the liquid discharge heads 2 among these two planes serves as a conveying surface 127 on which the printing paper P is conveyed.

As shown in FIG. 1, a conveying motor 174 is connected to the belt roller 106. The conveying motor 174 can rotate the belt roller 106 in the arrow A direction. The belt roller 107 can be rotated in conjunction with the conveying belt 111. Therefore, by driving the conveying motor 174 and rotating the belt roller 106, the conveying belt 111 is moved along the arrow A direction.

In the vicinity of the belt roller 107, a nip roller 138 and a nip receiving roller 139 are arranged so as to nip the conveying belt 111. The nip roller 138 is biased toward the lower side by a spring (not shown). The nip receiving roller 139 on the lower side of the nip roller 138 receives the nip roller 138 biased toward the lower side via the conveying belt 111. The two nip rollers are rotatably installed and rotated in conjunction with the conveying belt 111.

The printing paper P fed out from the paper feed unit 114 to the conveying unit 120 is nipped between the nip roller 138 and the conveying belt 111. Thereby, the printing paper P is pushed onto the conveying surface 127 of the conveying belt 111 and secured onto the conveying surface 127. The printing paper P is conveyed in the direction in which the liquid discharge heads 2 are installed in accordance with rotation of the conveying belt 111. It should be noted that a treatment with adhesive silicon rubber can be performed onto an outer peripheral surface 113 of the conveying belt 111. Thereby, the printing paper P can be reliably secured to the conveying surface 127.

Each of the liquid discharge heads 2 has a head main body 2*a* in a lower end. A lower surface of the head main body 2*a* serves as a discharge hole surface 4-1 where a number of discharge holes for discharging a liquid are provided.

From the discharge holes 8 provided in one liquid discharge head 2, liquid droplets (ink) of the same color are discharged. The liquid is supplied to the liquid discharge head 2 from an external liquid tank (not shown). The discharge holes 8 of the liquid discharge head 2 are opened on the discharge hole surface and arranged at equal intervals in one direction (in the direction parallel to the printing paper P and substantially orthogonal to the conveying direction of the printing paper P, the longitudinal direction of the liquid discharge head 2). Thus, printing can be done in the one direction without any gap. Colors of the liquid discharged from the liquid discharge heads 2 are for example magenta (M), yellow (Y), cyan (C), and black (K), respectively. The liquid discharge heads 2 are arranged between the lower surface of the head main body 2*a* and the conveying surface 127 of the conveying belt 111 with a slight gap.

The printing paper P conveyed by the conveying belt 111 passes through the gap between the liquid discharge heads 2 and the conveying belt 111. At that time, the liquid droplets are discharged from the head main bodies 2*a* forming the liquid discharge heads 2 toward an upper surface of the printing paper P. Thereby, on the upper surface of the printing paper P, a color image based on image data stored by the control section 100 is formed.

Between the conveying unit 120 and the paper receiving section 116, a detaching plate 140 and two pairs of feed rollers 121*a*, 121*b* and 122*a*, 122*b* are arranged. The printing paper P on which the color image is printed is conveyed to the detaching plate 140 by the conveying belt 111. At this time, the printing paper P is detached from the conveying surface 127 by a right end of the detaching plate 140. The printing paper P is fed to the paper receiving section 116 by the feed rollers 121*a* to 122*b*. In such a way, the printing papers P after printing are successively fed to the paper receiving section 116 and piled in the paper receiving section 116.

It should be noted that between the liquid discharge head 2 on the most upstream side in the conveying direction of the printing paper P and the nip roller 138, a paper surface sensor 133 is installed. The paper surface sensor 133 is formed by a light emitting element and a light receiving element, and can detect a leading end position of the printing paper P on the conveying route. A detection result by the paper surface sensor 133 is sent to the control section 100. By the detection result sent from the paper surface sensor 133, the control section 100 can control the liquid discharge heads 2, the conveying motor 174, and the like in such a manner that conveyance of the printing paper P is synchronized with printing of the image.

Figure 2:
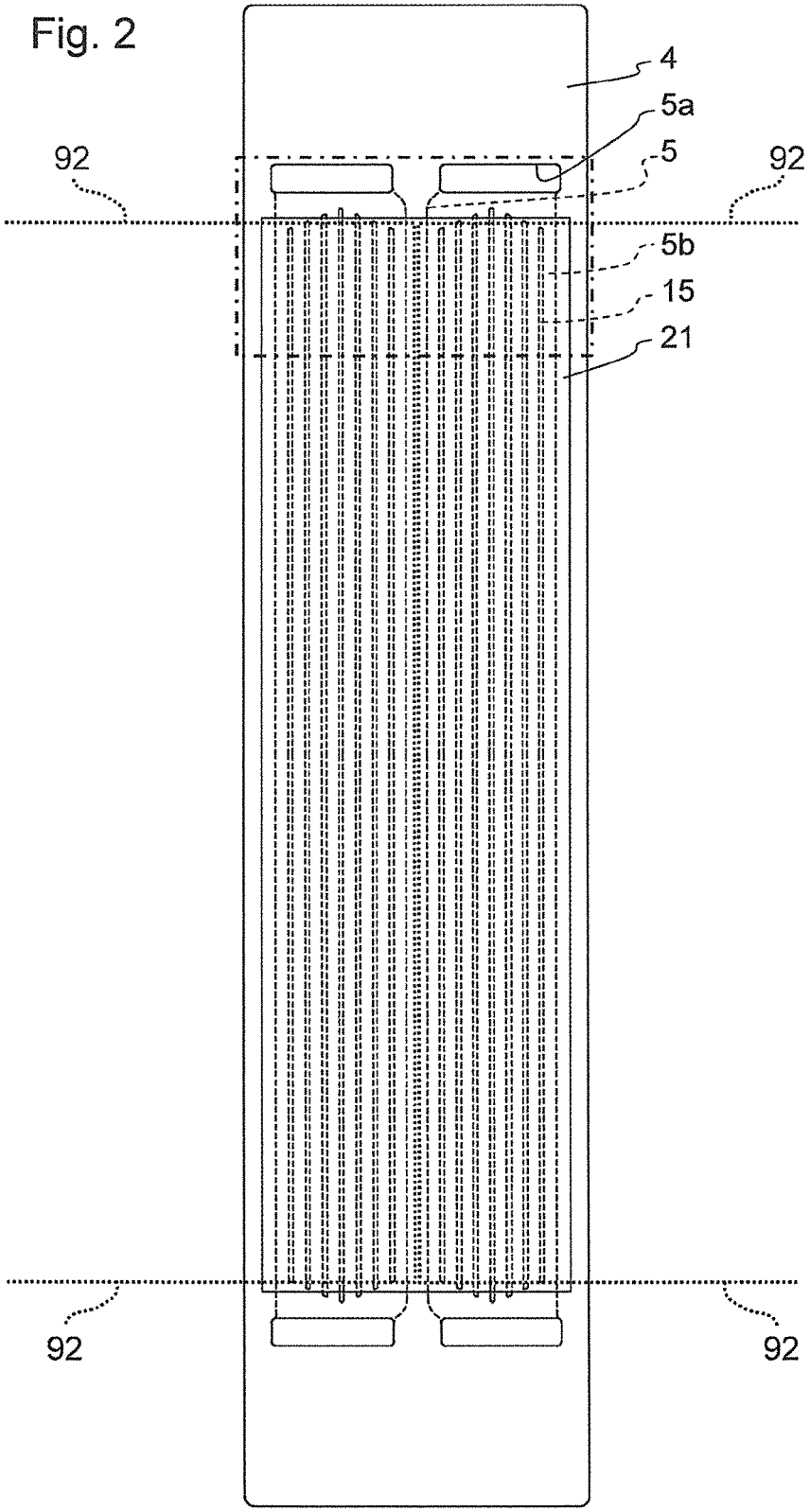
FIG. 2 is a plan view of a flow passage member and a piezoelectric actuator substrate forming a liquid discharge head of FIG. 1.
Figure 3:
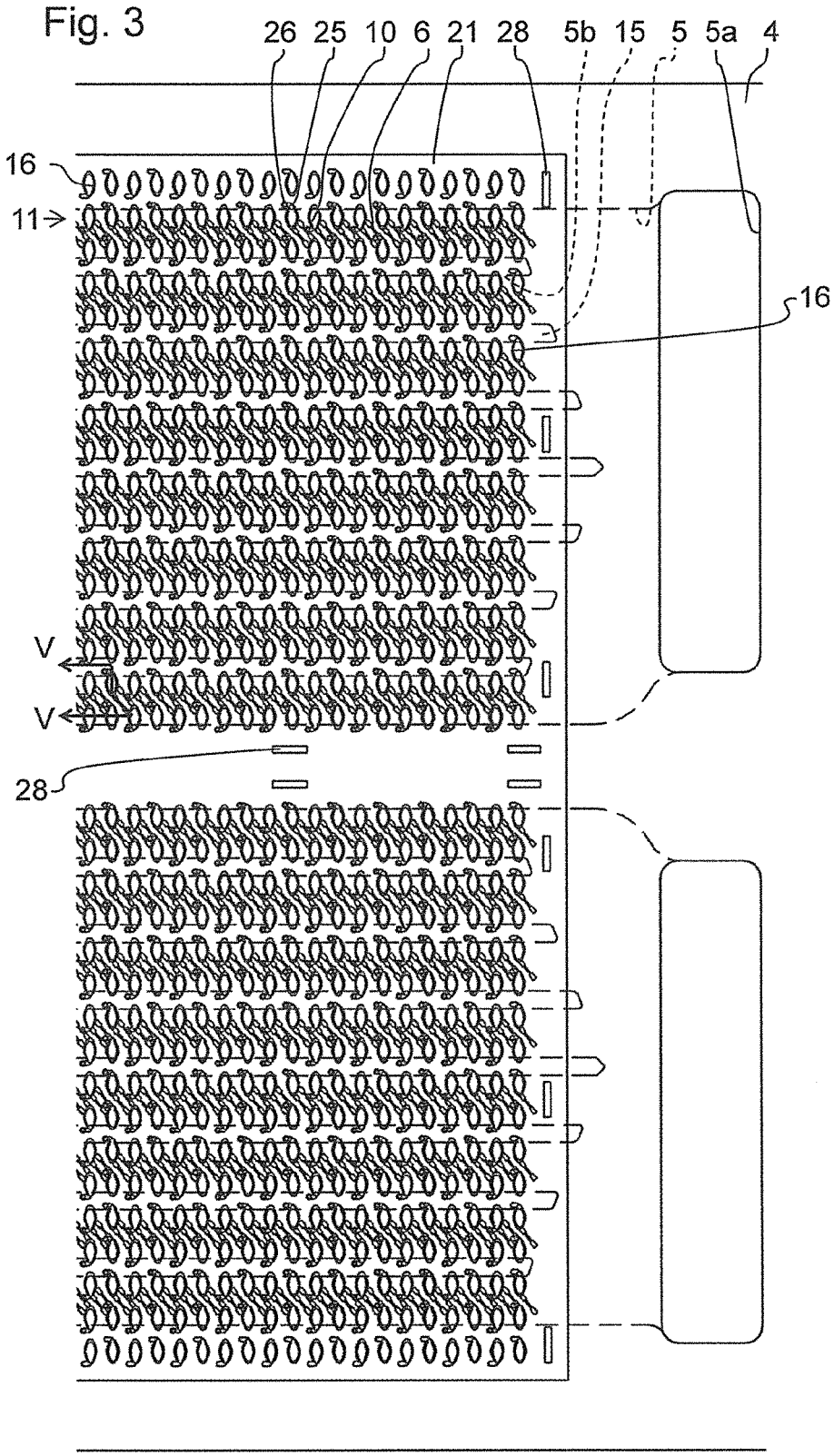
FIG. 3 is an enlarged view of a region surrounded by a one-chain line of FIG. 2, the view in which a part of the structure is omitted for description.
Figure 4:
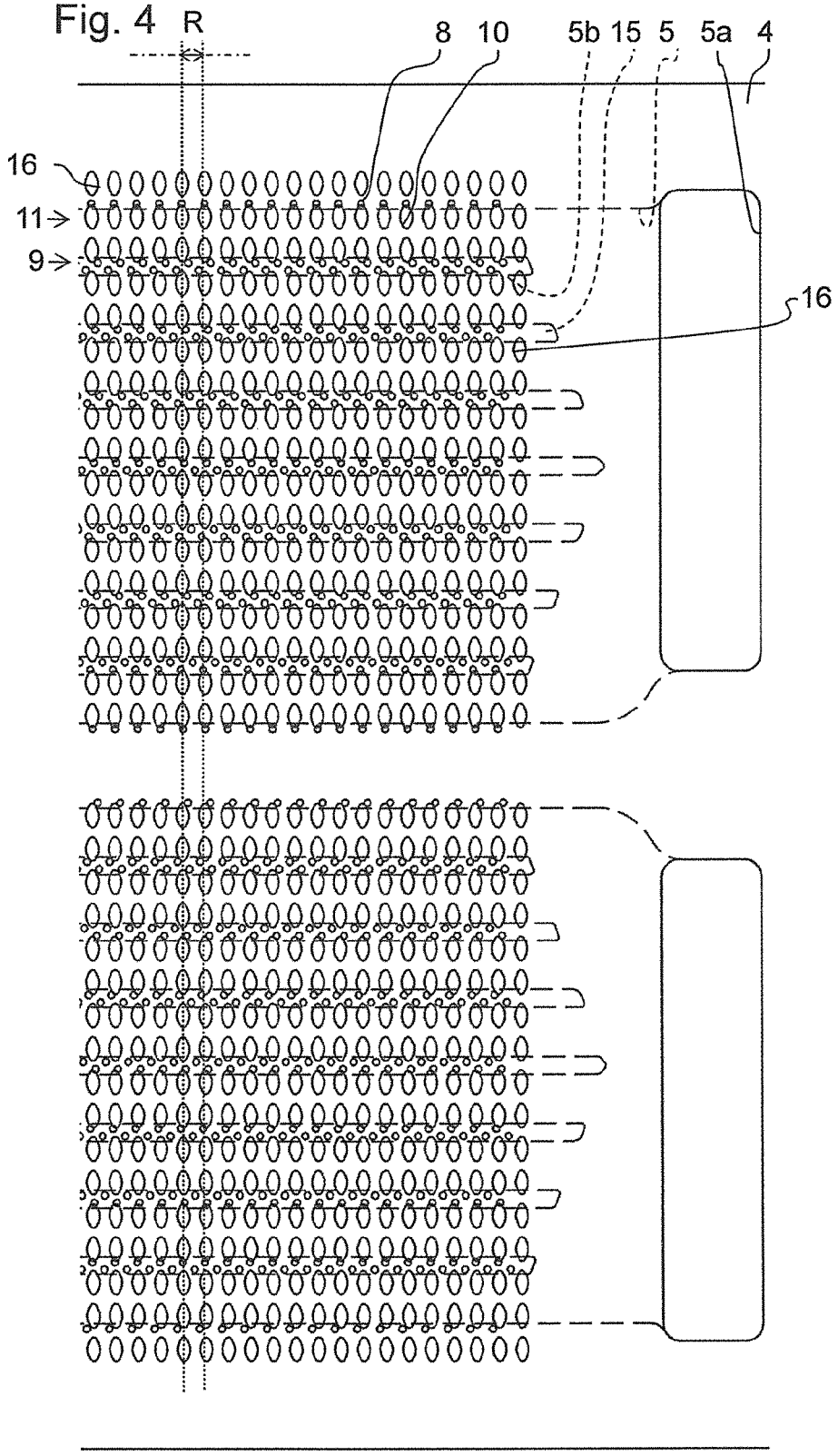
FIG. 4 is an enlarged view of the region surrounded by the one-chain line of FIG. 2, the view in which a part of the structure is omitted for description.
Figure 5:
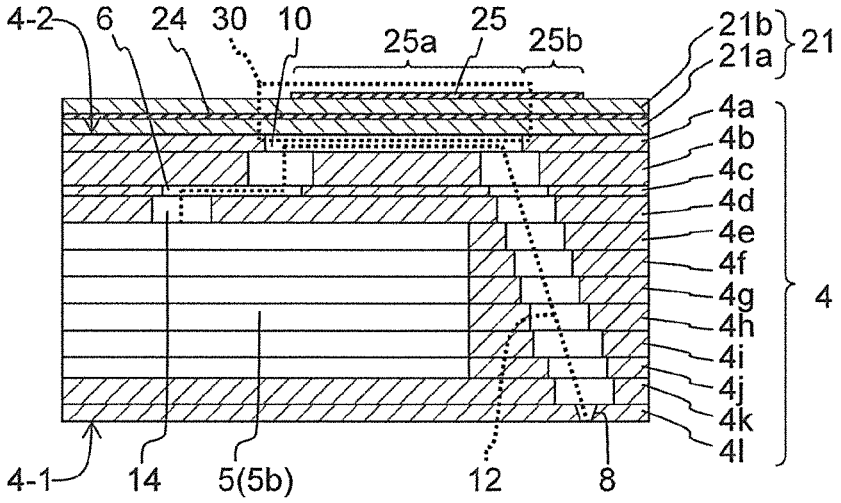
FIG. 5 is a vertically sectional view taken along the line V-V of FIG. 3.

Next, the liquid discharge head 2 of the present invention will be described. FIG. 2 is a plan view of a flow passage member 4 and a piezoelectric actuator substrate 21. FIG. 3 is an enlarged view of a region surrounded by a one-chain line of FIG. 2, the plan view in which a part of the structure is omitted for description. FIG. 4 is an enlarged view of the region surrounded by the one-chain line of FIG. 2, the view in which a part of the structure which is different from FIG. 3 is omitted for description. It should be noted that in FIGS. 3 and 4, for easier understanding of the figures, throttles 6, the discharge holes 8, pressurization chambers 10, and the like placed on the lower side of the piezoelectric actuator substrate 21 to be drawn by broken lines are drawn by solid lines. For easier understanding of positions, the discharge holes 8 of FIG. 4 are drawn to have a larger diameter than the actual diameter. FIG. 5 is a vertically sectional view taken along the line V-V of FIG. 3.

Figure 6A:
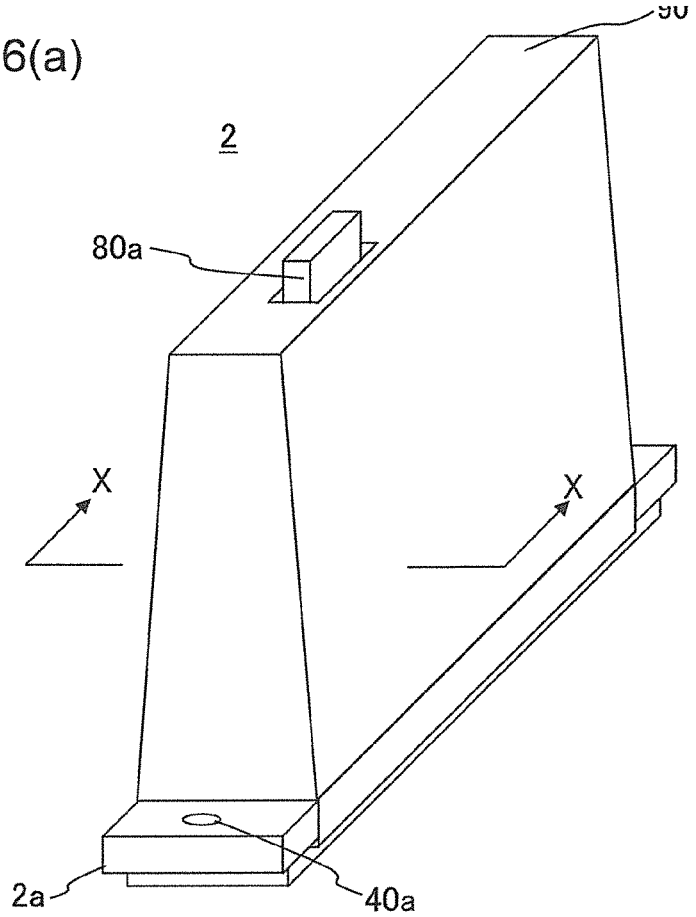
FIG. 6(*a*) is a perspective view of the liquid discharge head of FIG. 1.
Figure 6B:
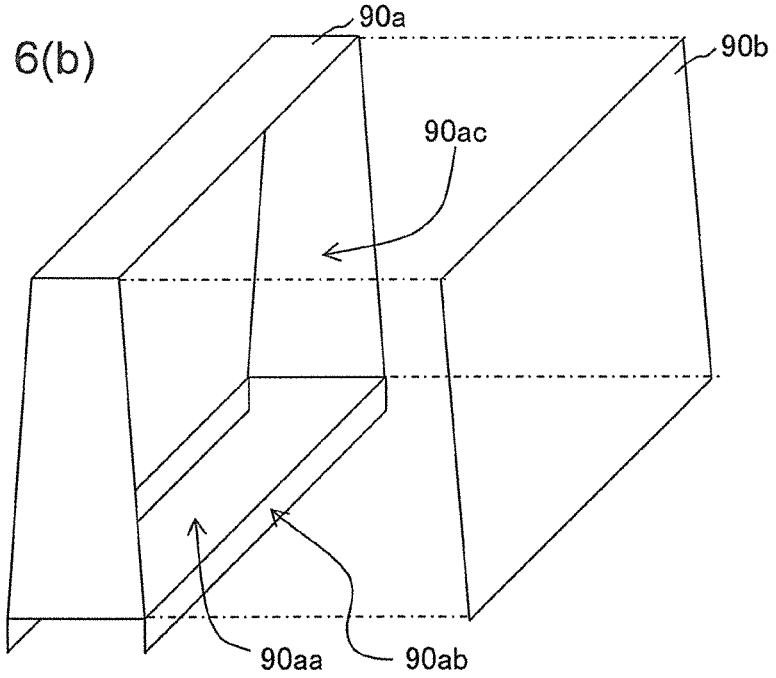
Figure 7:
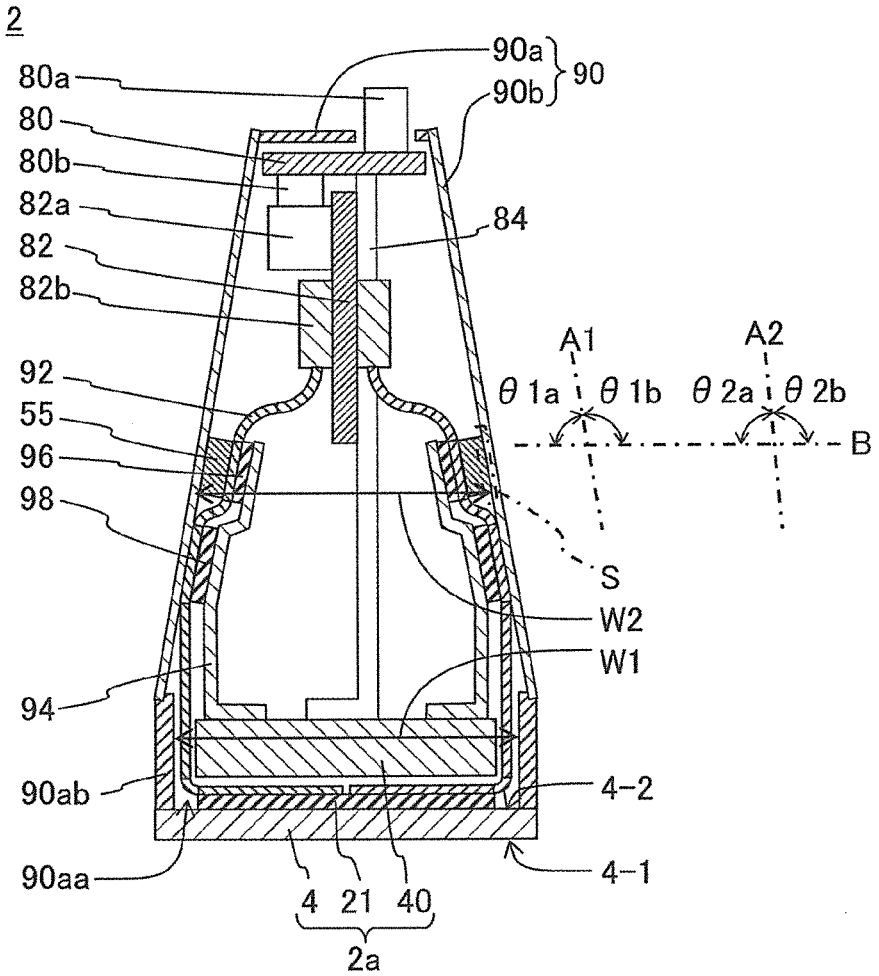
FIG. 7 is a vertically sectional view taken along the line X-X of the liquid discharge head of FIG. 6(*a*).

FIG. 6(*a*) is a perspective view of the liquid discharge head 2 of FIG. 1, and FIG. 6(*b*) is an exploded perspective view of a casing 90 of the liquid discharge head 2. FIG. 6(*b*) is a schematic view in which thickness of parts of the casing 90 is omitted. FIG. 7 is a vertically sectional view taken along the line X-X of the liquid discharge head 2 of FIG. 6(*a*). In FIG. 7, an internal structure of a flow passage such as the flow passage member 4 is omitted.

The liquid discharge head 2 includes the head main body 2*a* and the casing 90. Inside the casing 90, driver ICs (integrated circuits) 55 that drive the head main body 2*a* are accommodated. The head main body 2*a* is a part that discharges the liquid, and includes the flow passage member 4 through which the liquid flows and the piezoelectric actuator substrate 21 that pressurizes the liquid. Further, a reservoir 40 or the like may be included. In the casing 90 of the liquid discharge head 2, a connection substrate 80, a circuit substrate 82, flexible substrates 92 on which the driver ICs 55 are mounted, and the like may be included.

The casing 90 made of metal or the like has an opening 90*aa*, and is connected to the head main body 2*a* at an edge of the opening 90*aa*. The casing 90 has four side surfaces connected to the opening 90*aa* in a case where the opening 90*aa* faces the lower side, and an upper surface facing the opening 90*aa*. The four side surfaces are formed by two pairs of two facing side surfaces. One pair of side surfaces is placed along the longitudinal direction of the head main body 2*a*, and the other pair of side surfaces is placed along the short direction of the head main body 2*a*. The two side surfaces placed along the longitudinal direction are respectively inclined toward the inner side of the casing 90 with respect to the opening 90*aa*, and width of the head main body 2*a* of the casing 90 in the short direction is gradually decreased toward the upper surface.

The casing 90 is attached to the head main body 2*a* so as to cover a pressurization chamber surface 4-2 of the head main body 2*a*, and the above various substrates and the like are accommodated inside the casing 90. A hole is opened on the upper surface of the casing 90 so as to input signals via an external connector 80*a* of the connection substrate. The casing 90 is screwed to the head main body 2*a* or the like. According to need, a gap which may be created between the casing 90 and the other member is closed by resin, so that mist of the liquid does not easily come inside the casing 90. Inner surfaces of the casing 90 connected from the opening 90*aa* are in contact with the driver ICs 55, and heat generated by drive is diffused to an exterior through the casing. It should be noted that contact between the driver ICs 55 and the casing 90 includes a case where the driver ICs 55 are in direct contact with the casing 90 as well as a case where the driver ICs are in contact with the casing via grease enhancing thermal conductivity, a thin sheet, or the like. A shape of the casing 90 will be described in detail later.

Elastic plates 94 that push the driver ICs 55 onto the casing 90, and a frame 84 for fixing the circuit substrate 82 and the connection substrate 80 that process a drive signal for discharging the liquid from the casing 90 and the head main body 2*a* are fixed to a part of the head main body 2*a* covered by the casing 90. The drive signal sent from the control section 100 via a signal cable (not shown) passes through the connection substrate 80, the circuit substrate 82, the flexible substrates 92, and the driver ICs 55 mounted on the flexible substrates 92, drives displacement elements 30 of the piezoelectric actuator substrate 21 to be described later, and pressurizes the liquid inside the flow passage member 4. Thereby, the liquid droplets are discharged. It should be noted that the circuit substrate 82 may for example divide the drive signal into a plurality of piezoelectric actuator substrates 21 and additionally rectify the drive signal. Each of the flexible substrates 92 has a band shape having flexibility, and has a metal wire inside. A part of the wire is exposed onto a surface of the flexible substrate 92, and the flexible substrate is electrically connected to the circuit substrate 82, the driver IC 55, and the piezoelectric actuator substrate 21 by the exposed wire.

The driver IC 55 generates heat at the time of processing the drive signal. Since the driver IC 55 is pushed onto the casing 90 by the bent elastic plate 94, the generated heat is mainly transmitted to the casing 90, further quickly spread to the entire casing 90, and emitted to the exterior. When the driver IC 55 is flip-chip mounted and a surface opposite to a surface connected to the flexible substrate 92 where an electrode is arranged is brought into contact with the casing 90, heat can be easily transmitted. In order to facilitate heat emission, an outside surface of a side plate 90*b* of the casing may be uneven. A first heat insulating member 96 hinders heat from being transmitted to the head main body 2*a*. The first heat insulating member 96 may also be elastic to help push the driver IC 55 onto the casing 90.

The connection substrate 80 is not necessarily provided. However, in order to hinder the mist of the liquid or the like from coming in over the connection substrate 80 in the casing 90, the connection substrate is preferably provided. The external connector 80*a* of the connection substrate is mounted on an upper surface of the connection substrate 80, and an internal connector 80*b* of the connection substrate is mounted on a lower surface.

The head main body 2*a* includes the flow passage member 4 and the piezoelectric actuator substrate 21 into which the displacement elements (pressurization sections) 30 are made. The flow passage member 4 includes manifolds 5, a plurality of the pressurization chambers 10 connected to the manifolds 5, and a plurality of the discharge holes 8 respectively connected to a plurality of the pressurization chambers 10. The pressurization chambers 10 are opened on an upper surface of the flow passage member 4, and the upper surface of the flow passage member 4 serves as the pressurization chamber surface 4-2. The upper surface of the flow passage member 4 has openings 5*a* connected to the manifolds 5, and the liquid is supplied from the openings 5*a*.

The piezoelectric actuator substrate 21 including the displacement elements 30 which serve as the pressurization sections are bonded to the upper surface of the flow passage member 4, and each of the displacement elements 30 is provided so as to be placed on the pressurization chamber 10. The flexible substrates 92 for supplying the signal to the displacement elements 30 are electrically connected to the piezoelectric actuator substrate 21. In FIG. 2, for understanding of a state where the two flexible substrates 92 are connected to the piezoelectric actuator substrate 21, an outer form in the vicinity of connection between the flexible substrates 92 and the piezoelectric actuator substrate 21 is shown by dotted lines. An electrode of a wire 61 formed in the flexible substrate 92 is arranged in a rectangular shape in a connection region 60*c* between one end of the flexible substrate 92 and the piezoelectric actuator substrate 21. The two flexible substrates 92 are connected in such a manner that respective ends are placed in a center part of the piezoelectric actuator substrate 21 in the short direction. The two flexible substrates 92 extend from the center part in the short direction toward a long side of the piezoelectric actuator substrate 21.

The driver IC 55 is mounted on the flexible substrate 92. The drive signal that drives the displacement elements 30 on the piezoelectric actuator substrate 21 is generated in the driver IC 55 at the end based on the signal from the exterior. A signal that controls generation of the drive signal is generated in the control section 100 and inputted from the side of the circuit substrate 82 in one end of the band shape flexible substrate 92. The drive signal generated in the driver IC 55 is outputted to the piezoelectric actuator substrate 21 connected to the other end.

Next, the head main body 2*a* will be described. The head main body 2*a* has a shape elongated in one direction, and has the flat plate shape flow passage member 4, and one piezoelectric actuator substrate 21 including the displacement elements 30, the piezoelectric actuator substrate being connected on the flow passage member 4. A planar shape of the piezoelectric actuator substrate 21 is an oblong shape, and the piezoelectric actuator substrate is arranged on the upper surface of the flow passage member 4 in such a manner that a long side of the oblong shape is placed along the longitudinal direction of the flow passage member 4.

The two manifolds 5 are formed inside the flow passage member 4. Each of the manifolds 5 has a thin and long shape extending from the one end side of the flow passage member 4 in the longitudinal direction to the other end side. In both ends of the manifold, the openings 5*a* of the manifolds opened on the upper surface of the flow passage member 4 are formed. By supplying the liquid from both the ends of the manifolds 5 to the flow passage member 4, supply shortage of the liquid can be hindered from occurring. In comparison to a case of supplying from one ends of the manifolds 5, a difference of pressure loss generated at the time of the liquid flowing through the manifolds 5 can be substantially halved. Thus, variation of a liquid discharge characteristic can be reduced.

In each of the manifolds 5, at least a center part in the longitudinal direction which is a region connected to the pressurization chambers 10 is partitioned by partition walls 15 provided at intervals in the width direction. The partition walls 15 have the same height as the manifold 5 in the center part in the longitudinal direction which is the region connected to the pressurization chambers 10, and perfectly partition the manifold 5 into a plurality of sub-manifolds 5*b*. By doing so, the discharge holes 8 and descenders connected from the discharge holes 8 to the pressurization chambers 10 can be provided so as to overlap with the partition walls 15 when seen in a plan view.

In FIG. 2, the manifold is entirely partitioned by the partition walls 15 excluding both the ends of the manifold 5. The manifold may be entirely partitioned by the partition walls 15 including both the ends. In that case, when only parts in the vicinity of the openings 5*a* opened on the upper surface of the flow passage member 4 are not partitioned and the partition walls are provided between the openings 5*a* and parts of the flow passage member 4 in the depth direction, connection to the reservoir 40 is easily available.

The plural divided parts of the manifold 5 are sometimes called as the sub-manifolds 5*b*. In the present example, the two manifolds 5 are independently provided, and the openings 5*a* are provided in both the ends of the respective manifolds. In one of the manifolds 5, seven partition walls 15 are provided and the manifold is divided into eight sub-manifolds 5*b*. Width of the sub-manifold 5*b* is greater than width of the partition wall 15. Thereby, a large amount of the liquid can flow through the sub-manifolds 5*b*.

The flow passage member 4 is formed in such a manner that a plurality of the pressurization chambers 10 is two-dimensionally spread. Each of the pressurization chambers 10 is a hollow region having a substantially diamond-shaped planar shape, the region having two acute parts and two obtuse parts in which corner parts are rounded.

The pressurization chamber 10 is connected to one sub-manifold 5*b* via an individual supply flow passage 14. Along one sub-manifold 5*b*, one pressurization chamber row 11 serving as a row of the pressurization chambers 10 which is connected to this sub-manifold 5*b* is provided on each of both sides of the sub-manifold 5*b*. In total, two pressurization chamber rows are provided. Therefore, for one manifold 5, sixteen pressurization chamber rows 11 are provided, and for the entire head main body 2*a*, thirty-two pressurization chamber rows 11 are provided. The interval between the pressurization chambers 10 in the longitudinal direction is the same throughout the pressurization chamber rows 11, and for example, the interval is 37.5 dpi.

A dummy pressurization chamber 16 is provided in an end of each of the pressurization chamber rows 11. This dummy pressurization chamber 16 is connected to the manifold 5 but not connected to the discharge holes 8. On the outer sides of the thirty-two pressurization chamber rows 11, dummy pressurization chamber rows in which the dummy pressurization chambers 16 are aligned in a linear form are provided. Each of the dummy pressurization chambers 16 is connected neither to the manifold 5 nor to the discharge holes 8. By these dummy pressurization chambers 16, a surrounding structure (rigidity) of the pressurization chambers 10 right on the inner side of an end becomes close to a structure (rigidity) of the other pressurization chambers 10. Thereby, the difference of the liquid discharge characteristic can be reduced. It should be noted that since an influence of a difference of the surrounding structure is largely influenced by the pressurization chambers 10 which are near and adjacent in the longitudinal direction, the dummy pressurization chambers 16 are provided in both ends in the longitudinal direction. Since the influence is relatively small in the width direction, the dummy pressurization chambers are provided only in a part near an end of the head main body 2*a*. Thereby, the width of the head main body 2*a* can be decreased.

The pressurization chambers 10 connected to one manifold 5 are respectively arranged at substantially equal intervals on columns and on rows along the column direction serving as the longitudinal direction of the liquid discharge head 2 and the row direction serving as the short direction. The column direction is the same direction as a diagonal line connecting the obtuse parts of the diamond-shaped pressurization chamber 10, and the row direction is the same direction as a diagonal line connecting the acute parts of the diamond-shaped pressurization chamber 10. That is, the diagonal lines of the diamond shape of the pressurization chamber 10 are not angled on columns and rows. By arranging the pressurization chambers 10 in a grid form and arranging the pressurization chambers 10 of the diamond shape of such angles, cross talk can be reduced. This is because the corner parts of one pressurization chamber 10 face each other both in the column direction and in the row direction, and hence vibration is less easily transmitted through the flow passage member 4 than a case where sides of the pressurization chamber face each other. It should be noted that in this case, by letting the obtuse parts face each other in the longitudinal direction, the pressurization chambers can be arranged with increased density of the pressurization chambers 10 in the longitudinal direction. Thereby, density of the discharge holes 8 in the longitudinal direction can be increased. Thus, the liquid discharge head 2 can have high resolution. When the interval between the pressurization chambers 10 on columns and on rows is equal, any narrower intervals are eliminated, so that cross talk can be reduced. However, the interval may be different by about ±20%.

When the pressurization chambers 10 are arranged in a grid form and the piezoelectric actuator substrate 21 is formed in a rectangular shape having outer sides along the columns and the rows, individual electrodes 25 formed on the pressurization chambers 10 are arranged at equal intervals from the outer sides of the piezoelectric actuator substrate 21. Thus, at the time of forming the individual electrodes 25, the piezoelectric actuator substrate 21 can be less easily deformed. When this deformation is large at the time of bonding the piezoelectric actuator substrate 21 and the flow passage member 4, stress is added to the displacement elements 30 near the outer sides and there is a fear that a displacement characteristic is varied. However, by reducing the deformation, the variation can be lowered. Since the dummy pressurization chamber rows of the dummy pressurization chambers 16 are provided on the outer sides of the pressurization chamber rows 11 which are the nearest to the outer sides, an influence of the deformation can be less easily received. The pressurization chambers 10 belonging to the pressurization chamber row 11 are arranged at equal intervals, and the individual electrodes 25 corresponding to the pressurization chamber row 11 are also arranged at equal intervals. The pressurization chamber rows 11 are arranged at equal intervals in the short direction, rows of the individual electrodes 25 corresponding to the pressurization chamber rows 11 are also arranged at equal intervals in the short direction. Thereby, a part where the influence of cross talk is particularly increased can be eliminated.

By arranging the pressurization chambers in such a manner that the pressurization chambers 10 belonging to one pressurization chamber row 11 are not overlapped with the pressurization chambers 10 belonging to the adjacent pressurization chamber row 11 in the longitudinal direction of the liquid discharge head 2 when the flow passage member 4 is seen in a plan view, cross talk can be suppressed. Meanwhile, when a distance between the pressurization chamber rows 11 is extended, width of the liquid discharge head 2 is increased. Thus, a printing result is more largely influenced by precision of an angle of installing the liquid discharge head 2 in the printer 1 and precision of relative positions of the liquid discharge heads 2 at the time of using a plurality of the liquid discharge heads 2. Therefore, by making the width of the partition wall 15 smaller than that of the sub-manifold 5*b*, the printing result can be less influenced by those precision.

The pressurization chambers 10 connected to one sub-manifold 5*b* form two pressurization chamber rows 11 and the discharge holes 8 connected from the pressurization chambers 10 belonging to one pressurization chamber row 11 form one discharge hole row 9. The discharge holes 8 connected to the pressurization chambers 10 belonging to two pressurization chamber rows 11 are respectively opened on the different sides of the sub-manifold 5*b*. In FIG. 4, two discharge hole rows 9 are provided in the partition wall 15. The discharge holes 8 belonging to each of the discharge hole rows 9 are connected to the sub-manifold 5*b* on the side near the discharge holes 8 via the pressurization chambers 10. When the discharge holes are arranged so as not to be overlapped with the discharge holes 8 connected to the adjacent sub-manifold 5*b* via the pressurization chamber row 11 in the longitudinal direction of the liquid discharge head 2, cross talk between flow passages connecting the pressurization chambers 10 and the discharge holes 8 can be suppressed, so that cross talk can be further reduced. When the entire flow passages connecting the pressurization chambers 10 and the discharge holes 8 are arranged so as not to be overlapped with each other in the longitudinal direction of the liquid discharge head 2, cross talk can be further reduced.

By arranging and overlapping the pressurization chambers 10 and the sub-manifolds 5*b* with each other in a plan view, the width of the liquid discharge head 2 can be decreased. By making a ratio of an overlapping area with respect to an area of the pressurization chambers 10 80% or more or further 90% or more, the width of the liquid discharge head 2 can be more decreased. A bottom surface of a part of the pressurization chamber 10 where the pressurization chamber 10 and the sub-manifold 5*b* are overlapped with each other has lower rigidity than a case where the pressurization chamber is not overlapped with the sub-manifold 5*b*. There is a fear that the discharge characteristic is varied due to the difference of rigidity. By making a ratio of an area of the pressurization chamber 10 overlapped with the sub-manifold 5*b* with respect to the area of the entire pressurization chamber 10 substantially the same in every pressurization chamber 10, the variation of the discharge characteristic due to a change in rigidity of the bottom surface forming the pressurization chamber 10 can be reduced. The phrase "substantially the same" indicates that a difference of the ratio of the area is 10% or less, in particular 5% or less.

A pressurization chamber group is formed by a plurality of the pressurization chambers 10 connected to one manifold 5. Since two manifolds 5 are provided, two pressurization chamber groups are provided. Arrangement of the pressurization chambers 10 relating to discharging is the same in both the pressurization chamber groups, and the pressurization chambers are arranged so as to be moved in parallel in the short direction. These pressurization chambers 10 are arranged over the substantially entire surface in a region facing the piezoelectric actuator substrate 21 on the upper surface of the flow passage member 4 although the interval is slightly larger between the pressurization chamber groups or the like. That is, the pressurization chamber groups formed by these pressurization chambers 10 occupy a region having substantially the same size and shape as those of the piezoelectric actuator substrate 21. Openings of the pressurization chambers 10 are closed by bonding the piezoelectric actuator substrate 21 to the upper surface of the flow passage member 4.

From the corner part of the pressurization chamber 10 facing the corner part connected to the individual supply flow passage 14, the descender connected to the discharge hole 8 which is opened on the discharge hole surface 4-1 on a lower surface of the flow passage member 4 extends. The descender extends in the direction in which the descender goes away from the pressurization chamber 10 in a plan view. More specifically, while going away in the direction along the long diagonal line of the pressurization chamber 10, the descender extends and deviates to right and left with respect to the direction. Thereby, while the pressurization chambers 10 are arranged in a grid form in which the interval in the pressurization chamber row 11 is 37.5 dpi, the discharge holes 8 can be arranged at the interval of 1,200 dpi as a whole.

In other words, when the discharge holes 8 are projected so that the discharge holes are orthogonal to imaginary straight lines parallel to the longitudinal direction of the flow passage member 4, sixteen discharge holes 8 connected to each of the manifolds 5, thirty-two discharge holes 8 in total are placed at equal intervals of 1,200 dpi within a range R of the imaginary straight lines shown in FIG. 4. Thereby, by supplying the same color ink to all the manifolds 5, the image can be formed at resolution of 1,200 dpi in the longitudinal direction as a whole. One discharge hole 8 connected to one manifold 5 is placed at equal intervals of 600 dpi within the range R of the imaginary straight line. Thereby, by supplying the different color ink to the manifolds 5, an image of two colors can be formed at resolution of 600 dpi in the longitudinal direction as a whole. In this case, by using two liquid discharge heads 2, an image of four colors can be formed at resolution of 600 dpi. Printing precision is enhanced more than use of a liquid discharge head capable of printing at 600 dpi, and printing setting can be easily performed.

Further, in the liquid discharge head 2, the reservoir may be bonded to the flow passage member 4 so as to stabilize supply of the liquid from the openings 5*a* of the manifolds. By providing a flow passage that divides the liquid supplied from the exterior, the flow passage being connected to the two openings 5*a* in the reservoir, the liquid can be stably supplied to the two openings 5*a*. By making flow passage length after the division substantially equal, temperature variation and pressure variation of the liquid supplied from the exterior are transmitted to the openings 5*a* in both the ends of the manifolds 5 by a less time difference. Thus, the variation of the discharge characteristic of the liquid droplets in the liquid discharge head 2 can be more reduced. By providing a damper in the reservoir, supply of the liquid can be further stabilized. Further, a filter may be provided in order to suppress foreign substances in the liquid from going toward the flow passage member 4. Furthermore, a heater may be provided in order to stabilize a temperature of the liquid going toward the flow passage member 4.

The individual electrodes 25 are respectively formed at positions facing the pressurization chambers 10 on an upper surface of the piezoelectric actuator substrate 21. Each of the individual electrodes 25 includes an individual electrode main body 25*a* slightly smaller than the pressurization chamber 10, the individual electrode main body having a substantially identical shape to the pressurization chamber 10, and an extracting electrode 25*b* extracted from the individual electrode main body 25*a*. The individual electrodes 25 form individual electrode rows and individual electrode groups as well as the pressurization chambers 10. One end of the extracting electrode 25*b* is connected to the individual electrode main body 25*a*, and the other end passes through the acute part of the pressurization chamber 10 and is extracted to a region not overlapped with a row formed by extending the diagonal line connecting the two acute parts of the pressurization chamber 10 on the outer side of the pressurization chamber 10. Thereby, cross talk can be reduced.

Common electrode surface electrodes 28 electrically connected to a common electrode 24 through via holes are formed on the upper surface of the piezoelectric actuator substrate 21. Two rows of the common electrode surface electrodes 28 are formed along the longitudinal direction in a center part of the piezoelectric actuator substrate 21 in the short direction, and one row of the common electrode surface electrodes is formed along the short direction near an end in the longitudinal direction. Although the common electrode surface electrodes 28 shown in the figure are intermittently formed on a straight line, the common electrode surface electrodes may be continuously formed on a straight line.

The piezoelectric actuator substrate 21 is preferably formed by laminating and burning a piezoelectric ceramic layer 21*a* in which the via holes are formed, the common electrode 24, and a piezoelectric ceramic layer 21*b*, and then forming the individual electrodes 25 and the common electrode surface electrodes 28 in the same step. Positional variation between the individual electrodes 25 and the pressurization chambers 10 largely influences the discharge characteristic. When burning is performed after forming the individual electrodes 25, there is a fear that the piezoelectric actuator substrate 21 is warped. When the warped piezoelectric actuator substrate 21 is bonded to the flow passage member 4, stress is added to the piezoelectric actuator substrate 21, and there is a fear that displacement is varied due to an influence thereof. Thus, the individual electrodes 25 are desirably formed after burning. Similarly, there is a fear that the common electrode surface electrodes 28 are warped, and when the common electrode surface electrodes are formed at the same time as the individual electrodes 25, positional precision is enhanced and the step can be simplified. Thus, the individual electrodes 25 and the common electrode surface electrodes 28 are formed in the same step.

The two flexible substrates 92 are arranged in the piezoelectric actuator substrate 21 so as to respectively go to center from the sides of two long sides of the piezoelectric actuator substrate 21, and electrically connected to the piezoelectric actuator substrate 21. At that time, by forming and connecting connection electrodes 26 and common electrode connection electrodes on the extracting electrodes 25*b* of the piezoelectric actuator substrate 21 and the common electrode surface electrodes 28, respectively, connection is easily available. At that time, by making an area of the common electrode surface electrodes 28 and the common electrode connection electrodes larger than an area of the connection electrodes 26, connection in ends of the flexible substrates 92 (leading ends and ends in the longitudinal direction of the piezoelectric actuator substrate 21) can be strengthened by connection on the common electrode surface electrodes 28. Thus, the flexible substrates 92 can be less easily detached from the ends.

The discharge holes 8 are arranged at positions to avoid a region facing the manifolds 5 arranged on the lower surface side of the flow passage member 4. Further, the discharge holes 8 are arranged in a region facing the piezoelectric actuator substrate 21 on the lower surface side of the flow passage member 4. These discharge holes 8 occupy the region having substantially the same size and shape as those of the piezoelectric actuator substrate 21 as one group. By displacing the corresponding displacement elements 30 of the piezoelectric actuator substrate 21, the liquid droplets can be discharged from the discharge holes 8.

The flow passage member 4 included in the head main body 2*a* has a laminating structure in which a plurality of plates is laminated. These plates are a cavity plate 4*a*, a base plate 4*b*, an aperture (throttle) plate 4*c*, a supply plate 4*d*, manifold plates 4*e* to *j*, a cover plate 4*k*, and a nozzle plate 4*l* in this order from the upper surface of the flow passage member 4. A large number of holes are formed in these plates. Since thickness of each of the plates is about 10 to 300 μm, formation precision of the holes to be formed can be enhanced. The plates are laminated while positions are matched in such a manner that these holes communicate with each other and form an individual flow passage 12 and the manifolds 5. The head main body 2*a* has a configuration that, as in the pressurization chambers 10 on the upper surface of the flow passage member 4, the manifolds 5 on the lower surface side inside, and the discharge holes 8 on the lower surface, the parts forming the individual flow passage 12 are arranged at different positions in the vicinity of each other, so that the manifolds 5 and the discharge holes 8 are connected via the pressurization chambers 10.

The holes formed on the plates will be described. These holes include the followings. Firstly, the holes include the pressurization chamber 10 formed in the cavity plate 4*a*. Secondly, the holes include a communication hole forming the individual supply flow passage 14 connected from one end of the pressurization chamber 10 to the manifold 5. This communication hole is formed in the plates from the base plate 4*b* (in detail, an inlet of the pressurization chamber 10) to the supply plate 4*c* (in detail, an outlet of the manifold 5). It should be noted that this individual supply flow passage 14 includes the throttle 6 serving as a part formed in the aperture plate 4*c* where a sectional area of the flow passage is reduced.

Thirdly, the holes include a communication hole forming a flow passage providing communication between the other end of the pressurization chamber 10 and the discharge hole 8. This communication hole will be called as the descender (partial flow passage) in the following description. The descender is formed in the plates from the base plate 4*b* (in detail, an outlet of the pressurization chamber 10) to the nozzle plate 4*l* (in detail, the discharge hole 8). The hole of the nozzle plate 4*l* is a hole opened in an exterior of the flow passage member 4 having a diameter of for example 10 to 40 μm, the diameter being increased toward an interior. Fourthly, the holes include a communication hole forming the manifold 5. This communication hole is formed in the manifold plates 4*e* to *j*. In the manifold plates 4*e* to *j*, the hole is formed in such a manner that the partition wall 15 remains to form the submanifolds 5*b*. The partition wall 15 in the manifold plates 4*e* to *j* cannot be maintained when the entire part to be the manifold 5 become the hole. Thus, the partition wall 15 is connected to outer peripheries of the manifold plates 4*e* to *j* by a half-etched tab.

The first to fourth communication holes are connected to each other, so that the individual flow passage 12 running from an inflow port of the liquid from the manifold 5 (outlet of the manifold 5) to the discharge hole 8 is formed. The liquid supplied to the manifold 5 is discharged from the discharge hole 8 through the following route. Firstly, the liquid goes upward from the manifold 5, enters the individual supply flow passage 14, and reaches one end of the throttle 6. Next, the liquid advances horizontally along the extending direction of the throttle 6, and reaches the other end of the throttle 6. Then, the liquid goes upward and reaches one end of the pressurization chamber 10. Further, the liquid advances horizontally along the extending direction of the pressurization chamber 10 and reaches the other end of the pressurization chamber 10. While gradually moving in the horizontal direction, the liquid mainly goes downward and advances to the discharge hole 8 opened on the lower surface.

The piezoelectric actuator substrate 21 has a laminating structure including the two piezoelectric ceramic layers 21*a*, 21*b* serving as piezoelectric bodies. Each of these piezoelectric ceramic layers 21*a*, 21*b* has thickness of about 20 μm. Thickness of the piezoelectric actuator substrate 21 from a lower surface of the piezoelectric ceramic layer 21*a* to an upper surface of the piezoelectric ceramic layer 21*b* is about 40 μm. Any layer of the piezoelectric ceramic layers 21*a*, 21*b* extends so as to go over a plurality of the pressurization chambers 10. These piezoelectric ceramic layers 21*a*, 21*b* are made of for example a ceramics material of lead zirconium titanate (PZT) having a ferroelectric property.

The piezoelectric actuator substrate 21 has the common electrode 24 made of a metal material of Ag—Pd or the like, and the individual electrodes 25 made of a metal material of Au or the like. As described above, each of the individual electrodes 25 includes the individual electrode main body 25*a* arranged at a position facing the pressurization chamber 10 on the upper surface of the piezoelectric actuator substrate 21, and the extracting electrode 25*b* extracted from the individual electrode main body. The connection electrode 26 is formed in a part of one end of the extracting electrode 25*b*, the part extracted of a region facing the pressurization chamber 10. The connection electrodes 26 are made of silver-palladium for example including glass frit, and formed in a projected shape with thickness of about 15 μm. The connection electrodes 26 are electrically connected to electrodes provided in the flexible substrates 92. Although details will be described later, the drive signal is supplied to the individual electrodes 25 from the control section 100 through the flexible substrates 92. The drive signal is supplied in a fixed cycle in synchronization with conveying speed of the printing medium P.

The common electrode 24 is formed over the substantially entire surface in the planar direction in a region between the piezoelectric ceramic layer 21*a* and the piezoelectric ceramic layer 21*b*. That is, the common electrode 24 extends so as to cover all the pressurization chambers 10 in the region facing the piezoelectric actuator substrate 21. Thickness of the common electrode 24 is about 2 μm. The common electrode 24 is connected to the common electrode surface electrodes 28 formed at the positions to avoid the electrode groups of the individual electrodes 25 on the piezoelectric ceramic layer 21*b* through the via holes formed on the piezoelectric ceramic layer 21*b*, and grounded and retained with ground potential. The common electrode surface electrodes 28 are connected to other electrodes on the flexible substrates 92 as well as a large number of individual electrodes 25.

It should be noted that as described later, by selectively supplying a predetermined drive signal to the individual electrode 25, a volume of the pressurization chamber 10 corresponding to this individual electrode 25 is changed, so that pressure is added to the liquid in the pressurization chamber 10. Thereby, the liquid droplets are discharged from the corresponding discharge hole 8 through the individual flow passage 12. That is, the part of the piezoelectric actuator substrate 21 facing the pressurization chamber 10 corresponds to the individual displacement element 30 corresponding to the pressurization chamber 10 and the discharge hole 8. That is, in a laminating body including the two piezoelectric ceramic layers 21*a*, 21*b*, the displacement element 30 serving as a piezoelectric actuator which has the structure shown in FIG. 5 as a unit structure is made from the vibration plate 21*a* placed immediately above the pressurization chamber 10, the common electrode 24, the piezoelectric ceramic layer 21*b*, and the individual electrode 25 for every pressurization chamber 10. The piezoelectric actuator substrate 21 includes a plurality of the displacement elements 30 serving as the pressurization sections. It should be noted that in the present embodiment, an amount of the liquid discharged from the discharge hole 8 by one discharge action is about 1.5 to 4.5 pl (picoliters).

A large number of individual electrodes 25 are individually electrically connected to the control section 100 respectively via the flexible substrates 92 and the wires in such a manner that the potential can be individually controlled. When an electric field is applied to the piezoelectric ceramic layer 21*b* in the polarization direction thereof with the potential of the individual electrode 25 different from that of the common electrode 24, this part to which the electric field is applied works as an active part to be distorted by a piezoelectric effect. In this configuration, when the individual electrode 25 is set with positive or negative predetermined potential with respect to the common electrode 24 by the control section 100 in such a manner that the electric field and the polarization are in the same direction, a part of the piezoelectric ceramic layer 21*b* sandwiched by the electrodes (active part) is contracted in the planar direction. Meanwhile, since the piezoelectric ceramic layer 21*a* of an inactive layer is not influenced by the electric field, the piezoelectric ceramic layer is not spontaneously contracted but regulates deformation of the active part. As a result, a difference is generated in distortion in the polarization direction between the piezoelectric ceramic layer 21*a* and the piezoelectric ceramic layer 21*b*, and the piezoelectric ceramic layer 21*b* is deformed (unimorph-deformed) so as to be projected to the side of the pressurization chamber 10.

In an actual driving procedure in the present embodiment, the potential of the individual electrode 25 is made higher than that of the common electrode 24 (hereinafter, referred to as the high potential) in advance, the potential of the individual electrode 25 is once made the same potential as that of the common electrode 24 (hereinafter, referred to as the low potential) every time a discharge request is made, and then the potential is made the high potential again at predetermined timing. Thereby, at the timing when the potential of the individual electrode 25 becomes the low potential, the piezoelectric ceramic layers 21*a*, 21*b* are restored to the original shape, and a capacity of the pressurization chamber 10 is increased in comparison to an initial state (state where the potentials of both the electrodes are different from each other). At this time, negative pressure is given in the pressurization chamber 10, and the liquid is suctioned from the side of the manifold 5 into the pressurization chamber 10. After that, at the timing when the potential of the individual electrode 25 is made the high potential again, the piezoelectric ceramic layers 21*a*, 21*b* are deformed to be projected to the side of the pressurization chamber 10, pressure in the pressurization chamber 10 becomes positive pressure due to a decrease in the capacity of the pressurization chamber 10, and the pressure onto the liquid is boosted, so that the liquid droplets are discharged. That is, in order to discharge the liquid droplets, a drive signal including a pulse based on the high potential is supplied to the individual electrode 25. This pulse width is ideally acoustic length (AL) which is length of time for propagating a pressure wave from the throttle 6 to the discharge hole 8. With this, when an interior of the pressurization chamber 10 is reversed from a negative pressure state to a positive pressure state, pressure of the both is added, so that the liquid droplets can be discharged with stronger pressure.

In gradation printing, a gradation is expressed by the number of the liquid droplets continuously discharged from the discharge hole 8, that is, a liquid droplet amount (volume) adjusted by the number of discharging the liquid droplets. Therefore, the liquid droplets are continuously discharged by the number of times corresponding to designated gradation expression from the discharge hole 8 corresponding to a designed dot region. In general, in a case where the liquid is continuously discharged, a gap between a pulse and a pulse supplied for discharging the liquid droplets is preferably AL. Thereby, a cycle of the remaining pressure wave of pressure generated upon discharging of the liquid droplets to be firstly discharged is matched with a cycle of a pressure wave of pressure generated upon discharging of the liquid droplets to be discharged later, and these are superimposed and the pressure for discharging the liquid droplets can be amplified. It should be noted that in this case, speed of the liquid droplets discharged later is supposed to be increased, and this is preferable as impact points of the plural liquid droplets become near to each other.

Upon manufacturing such a liquid discharge head 2, at the time of attaching the casing 90 to the head main body 2*a* to which the driver ICs 55 and the like are attached, the casing 90 is brought close to the head main body 2*a* from the opening 90*aa*, and the opening 90*aa* is abutted with the head main body 2*a*. When the inner surfaces of the casing are orthogonal to the opening 90*aa* or spread to the outer side of the casing 90 with respect to the opening 90*aa* unlike the present embodiment, there is a fear that the driver ICs 55 and the casing 90 are brought into contact with each other and damaged at the time of assembling.

In order to push the driver ICs 55 onto the casing 90, in a step before assembling, the driver ICs 55 are preferably arranged so as to be placed on the outer side of parts of the casing 90 with which the driver ICs 55 are abutted. For example, in FIG. 7, when a distance W2 [mm] (hereinafter, the unit will sometimes be omitted) between the driver ICs after assembling is smaller than a distance W3 [mm] between the driver ICs 55 before assembling (not shown), the elastic plates 94 can push the driver ICs 55 onto the casing 90 by a pushed and bent amount thereof. In that case, when the inner surfaces of the casing 90 are orthogonal to the opening 90*aa* or spread to the outer side of the casing 90 with respect to the opening 90*aa*, the elastic plates 94 have to be pushed and bent at the time of bringing the driver ICs 55 into the casing 90. Further, the driver ICs 55 and the casing 90 have to be moved to rub each other up to parts onto which the driver ICs 55 are pushed.

By arranging the driver ICs 55 in such a manner that the driver ICs are abutted with inclination portions S inclined toward the inner side of the casing 90 on the inner surfaces of the casing 90, a distance of moving the driver ICs 55 and the inner surfaces of the casing 90 to rub each other can be shortened, so that a possibility that the driver ICs 55 and the like are damaged can be reduced. It should be noted that at the time of assembling, by providing a buffer material between the driver ICs 55 and the inner surfaces of the casing 90 and removing the buffer material after assembling, the possibility of damage can be reduced. Even in such a case, by reducing the distance of moving to rub, the possibility of damage can be more reduced.

A distance W1 [mm] between the opening 90*aa* of the casing 90 is preferably larger than the distance W3, since there is no need for bending the elastic plates 94 at the time of bringing the driver ICs 55 into the opening 90*aa*.

The reference sign B in FIG. 7 denotes a plane parallel to a plane formed by a part on the side of the head main body 2*a* of the opening 90*aa*. This is also a plane parallel to the pressurization chamber surface 4-2 serving as a major part of the head main body 2*a* with which the casing 90 is abutted. The reference sign A1 denotes a plane parallel to the inner surface of the casing 90 in a part in contact with the driver IC 55. The plane A1 is a plane going closer to the inner side of the casing 90 as going more distant from the head main body 2*a*. In other words, regarding angles θ1*a* and θ1*b* made by the planes B and A1, the angle θ1*a* of an angle on the inner side of the casing 90 is smaller. In such a way, the width W2 [mm] in the part of the casing 90 in contact with the driver IC 55 (inclination portion 5) (width of the greatest part among the inclination portion 5) is smaller than the width W1 [mm] of the casing 90 in the opening 90*aa*. Thus, a possibility that the driver IC 55 rubs in a state where the driver IC is abutted with the inner surface of the casing 90 can be reduced. It should be noted that the angle θ1*a* is for example 70 to 89 degrees, and a further preferable range is 80 to 85 degrees.

Since an outer surface is inclined at the similar angle to inclination of the inner surface, an area of a part of emitting heat is increased, so that a heat emission property can be enhanced. In other words, when a part of the outer surface of the side plate 90*b* placed on the opposite side of the inclination portion S is inclined toward the inner side of the casing with respect to the opening 90*aa*, the heat emission property can be enhanced. A ratio of a region where the outer surface is inclined is desirably high, 50% or more, more preferably 90% or more of the side plate 90*b*, further the entire side plate 90*b* may be inclined.

When a position of the driver IC 55 at the time of removing the casing 90 is placed on the inner side of the casing 90 with respect to the part where the casing 90 is abutted with the head main body 2*a*, the possibility that the driver IC 55 rubs in a state where the driver IC is abutted with the inner surface of the casing 90 can be more reduced.

The reference sign A2 denotes a plane parallel to a surface of the driver IC 55 in a part in contact with the casing 90. The plane A2 is a plane going closer to the inner side of the casing 90 as going more distant from the head main body 2*a*. Regarding angles θ2*a* and θ2*b* made by the planes B and A2, the angle θ2*a* of an angle on the inner side of the casing 90 is smaller. In such a way, a difference of an angle at which the inner surface of the casing 90 and the driver IC 55 are abutted with each other is reduced. Thus, an impact at the time of abutting is more reduced, so that a possibility that the driver IC 55 is damaged can be more reduced. The angle θ2*a* is larger than the angle θ1*a*, which is 89 degrees or less, and a more preferable range is larger than the angle θ2*a*, which is θ2*a*+5 degrees or less.

By abutting the driver IC 55 with a part of the inner surface along the longitudinal direction of the head main body 2*a*, heat is preferably emitted to the exterior from a large surface. When the driver IC 55 is abutted with a plurality of the inner surfaces, the number of surfaces from which heat is emitted to the exterior can be preferably increased. In this case, one driver IC 55 may be abutted with a plurality of the inner surfaces or a plurality of the driver ICs 55 may be abutted with different inner surfaces. In any case, when the driver IC(s) is abutted with both the inner surfaces of the side plates arranged to face each other along the longitudinal direction (hereinafter, both the inner surfaces will sometimes be referred to as the facing inner surfaces), an area of heat emission can be preferably increased. In FIG. 7, the driver ICs 55 are respectively abutted with the pair of facing inner surfaces placed on the left and the right in the sectional view, the inner surfaces being arranged to face each other along the longitudinal direction in a preferable state.

In such a case, the driver ICs 55 are abutted with both the facing inner surfaces of the casing 90. Thus, the width W1 is more highly required to be greater than the width W2. It should be noted that even in a case where the driver ICs 55 are not abutted with both the sides of the facing inner surfaces but abutted with one of the inner surfaces, the casing 90 is moved so as to be substantially orthogonal to the pressurization chamber surface 4-2 with which the opening 90*aa* is abutted and attached to the head main body 2*a* in general. In such an attachment action, a position where the driver IC 55 is abutted with the inclination portion S is preferably placed on the inner side of the opening 90*aa* of the casing with respect to the short direction of the head main body 2*a* so that the inner surface of the casing 90 and the driver IC 55 less likely to rub each other. A position of a part of the driver IC 55 before attaching the casing 90, the part on the outermost side in the short direction of the head main body 2*a* is preferably placed on the inner side of the opening 90*aa* of the casing.

The entire casing 90 may be formed by one member or the casing may be formed by combining plural members. The casing 90 formed by one member can be formed by pressing from a metal plate such as a stainless steel plate and an aluminum plate. At that time, the side plate 90*b* is preferably inclined as pressing is easily performed. The casing 90 formed by one member can be manufactured at low cost by bending, welding, and screwing a metal plate.

When the casing 90 seamlessly integrated by pressing is used, heat is promptly transmitted from the driver IC 55 to the entire casing 90 and emitted from the entire casing 90. Thus, efficiency of heat emission can be enhanced. At the time of pressing, since the casing 90 adheres to a press die due to elasticity of metal, a punching mechanism (knockout) is required. However, by making inclination of the outer surface of the side plate 90*b* of the casing smaller than 90°, punching force can be reduced. Thus, a defect, a dent, and the like are not easily caused in a product due to knockout. The inclination is preferably 70 to 89 degrees, further preferably 80 to 85 degrees.

FIG. 6(*b*) is an example in which the casing 90 is formed by plural members, showing a structure in which two side plates 90*b* (one of the two side plates is shown in the figure) are attached to a casing main body 90*a*. The side plates 90*b* form the substantially entire two surfaces parallel to each other in the longitudinal direction of the head main body 2*a* among the side surfaces of the casing. The casing main body 90*a* is provided along ends of the side plates 90*b*, and the side plates 90*b* are attached so as to close side surface openings 90*ac* opened in the casing main body 90*a*. The casing main body 90*a* is formed by a top plate of the casing 90, the side surfaces along the short direction of the head main body 2*a*, and a casing main body lower portion 90*ab*.

Since the casing main body 90*a* is provided along the ends of the side plates 90*b*, the opening 90*aa* of the casing 90 also serves as the opening 90*aa* for the casing main body 90*a*. The casing main body lower portion 90*ab* forming the opening 90*aa* and serving as a part on the lower side of the side plates 90*b* is provided for enhancing rigidity of the casing main body 90*a* and for enhancing reliability of bonding between the casing 90 and the head main body 2*a*. When the side plates 90*b* are attached after attaching the casing main body 90*a* to the head main body 2*a*, a possibility that the inner surfaces of the side plates 90*b* and the driver ICs 55 are abutted to rub each other can be preferably reduced. In such a way, by manufacturing the casing main body 90*a* with inexpensive resin having high freedom of forming and manufacturing the plate shape side plates 90*b* with highly thermally conductive metal, the casing 90 having a complicated shape can be easily manufactured at low cost.

It should be noted that when the casing main body lower portion 90*ab* is provided, there is a fear that the driver IC 55 and the casing main body lower portion 90*ab* are brought into contact with each other at the time of attaching the casing main body 90*a* to the head main body 2*a*. Thus, the position of the driver IC 55 is required to be placed on the inner side of the edge of the opening 90*aa* as in the above case.

One of reasons why there is a need for heat emission from the driver IC 55 is that a temperature of the driver IC 55 is increased and the driver IC is disabled. Heat may also influence other parts of the liquid discharge head 2. Since the flexible substrate 92 easily transmits heat by the wire electrically connected to the driver IC 55, heat transmitted through the flexible substrate 92 easily influences parts ahead.

When the flexible substrate 92 is abutted with the casing 90, heat also escapes from the abutted part to the casing 90, so that the members inside the casing 90 can be less easily influenced by heat of the driver IC 55. The flexible substrate 92 may be pushed onto the casing 90 for example by transmitting force of the elastic plate 94 returning from a bent state via a second heat insulating member 98.

Since the piezoelectric actuator substrate 21 is connected to the driver IC 55 via the flexible substrate 92, heat is relatively easily transmitted. When a piezoelectric characteristic includes temperature dependency, a displacement amount is different between a high temperature part and a low temperature part. Thus, the discharge characteristic is varied by transmission of heat. Thus, a part of the flexible substrate 92 on the side of the piezoelectric actuator substrate 21 with respect to a part where the driver IC 55 is mounted, that is, the part on the side of the head main body 2*a* may be abutted with the inner surface of the casing 90. When the elastic plate 94 is formed in a shape of standing from the head main body 2*a* along the casing 90, the driver IC 55 and the flexible substrate 92 can be preferably pushed onto the casing 90 by one elastic plate 94.

When a man holds the liquid discharge head 2, side surfaces along the longitudinal direction are easily holdable. Further, in order to avoid ink adhesion to the discharge hole surface 4-1 or not to damage the discharge holes 8, the liquid discharge head is highly possibly held from the non-discharge hole surface 4-1 side, in particular, the opposite side to the discharge hole surface 4-1. At such a time, in a case of the above mode shown in FIG. 6(*a*), the width becomes narrower as the facing side surfaces of the casing 90 are more distant from the discharge hole surface 4-1. Thus, there is a possibility that the liquid discharge head 2 may be dropped off. When a vertically sectional shape of plates of the side surfaces is formed in a wedge shape, the outer surfaces can be substantially parallel to each other while the facing inner surfaces are inclined. The state where the outer surfaces are substantially parallel to each other indicates a state where an angle made by the outer surfaces is smaller than an angle made by the facing inner surfaces. In this case, it is thought that the angle made by the parallel surfaces is zero degrees for convenience. In such a way, at the time of holding the liquid discharge head 2 in hand or the like, the liquid discharge head can be less easily dropped off. The angle made by the outer surfaces is preferably smaller than the angle made by the facing inner surfaces by one degree or more. The angle made by the outer surfaces is preferably 10 degrees or less, in particular, 5 degrees or less.

Figure 8:
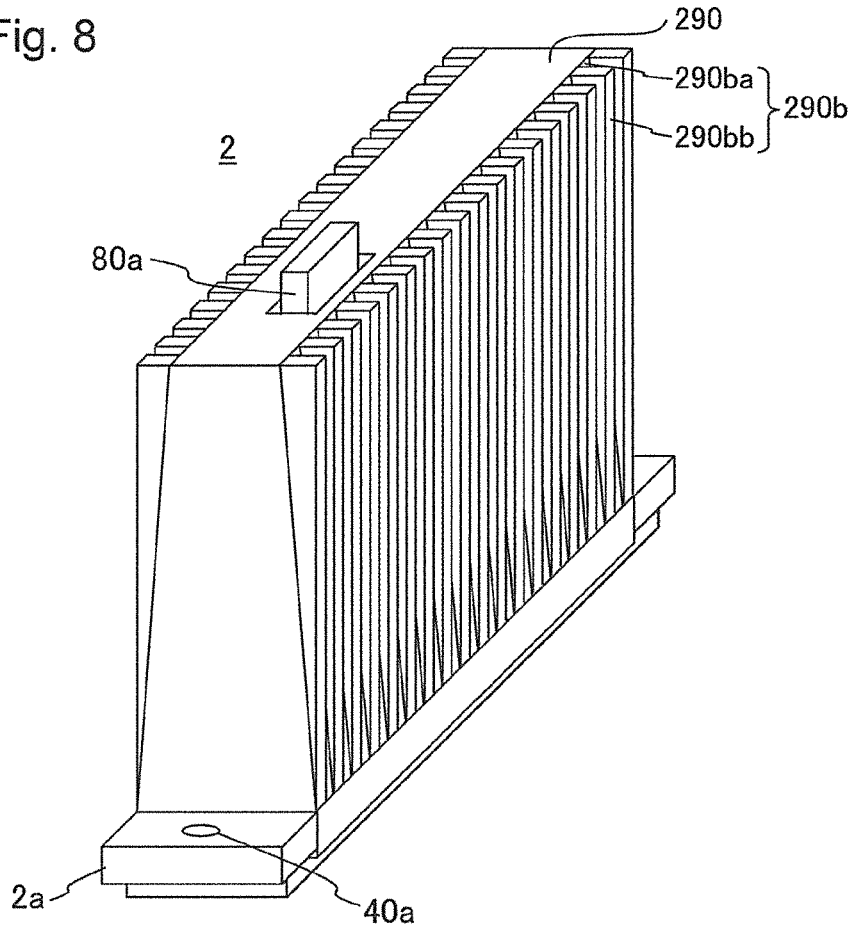
FIG. 8 is a perspective view of another liquid discharge head of the present invention.

Further, as shown in FIG. 8, a side plate 290*b* may include a plate shape side plate base portion 290*ba* in which one surface serves as the inner surface of the casing 90, and a plurality of fins 290*bb* extending from the side plate base portion toward the outer side of the casing 90. A plane formed by leading ends of a plurality of the fins 290*bb* is parallel to the other outer surfaces (including a case where the plane is parallel to a plane formed by leading ends of a plurality of fins 290*bb* of another side plate 290*b*). In such a way, as well as the above case, the liquid discharge head 2 can be less easily dropped off and the heat emission property is enhanced by the fins 290*bb*.

In FIG. 8, the fins 290*bb* are provided so as to extend in the height direction of the liquid discharge head 2. In a case where a plurality of the driver ICs 55 is abutted side by side in the longitudinal direction of the head main body 2*a* on the inner surface of the casing 90, the fins provided in such a way are preferable as heat is easily spread in the height direction of the liquid discharge head 2.

In a case where a planar shape of the driver IC 55 is elongated in one direction, by making the longitudinal direction of the driver IC 55 cross the extending direction of the fins 290*bb* and increasing the number of the fins 290*bb* overlapped with the driver IC 55, an amount of heat escaping from the driver IC 55 is preferably increased by the increased number of the fins 290*bb*. The longitudinal direction of the driver IC 55 is preferably orthogonal to the extending direction of the fins 290*bb*. Further, in order to decrease temperature distribution in the longitudinal direction in the head main body 2*a*, the driver IC 55 is set in such a manner that the longitudinal direction of the driver IC 55 is placed along the longitudinal direction of the head main body 2*a*. In a case where a plurality of the driver ICs 55 is provided, the driver ICs are preferably aligned along the longitudinal direction of the head main body 2*a*.

It should be noted that when the fins 290*bb* are provided so as to extend in the longitudinal direction of the head main body 2*a* or uneven parts extending in the longitudinal direction of the liquid discharge head 2 are attached to the leading ends of the fins 290*bb* extending along the height direction of the liquid discharge head 2, the liquid discharge head 2 is less easily dropped off at the time of holding the liquid discharge head 2 from the direction of the top plate. The fins 290*bb* may be integrated with the side plate 290*b* or may be attached to the side plate 290*b*. In a case where the casing 90 is processed by pressing, the fins 290*bb* manufactured by die casting may be bonded to an integrated casing main body including the side plate 290*b* which is processed by pressing.

It should be noted that in the present example, the displacement elements 30 using piezoelectric deformation are shown as the pressurization sections. However, the present invention is not limited to this but any other elements capable of pressurizing the liquid in the liquid pressurization chambers 10 may be used. For example, elements that generate pressure by heating and boiling the liquid in the liquid pressurization chambers 10 or elements using micro electro mechanical systems (MEMS) may be used.

REFERENCE SIGNS LIST

1: Printer
2: Liquid discharge head
2*a*: Head main body
4: Flow passage member
4*a* to 1: Plate (of flow passage member)
5: Manifold
5: Manifold
5*a*: Opening (of manifold)
5*b*: Sub-manifold
6: Throttle
8: Discharge hole
9: Discharge hole row
10: Pressurization chamber
11: Pressurization chamber row
12: Individual flow passage
14: Individual supply flow passage
15: Partition wall
21: Piezoelectric actuator substrate
21*a*: Piezoelectric ceramic layer (vibration plate)
21*b*: Piezoelectric ceramic layer
24: Common electrode
25: Individual electrode
26: Connection electrode
30: Displacement element (pressurization section)
40: Reservoir
40*a*: Liquid supply hole (of reservoir)
55: Driver IC
60*c*: Connection region to piezoelectric actuator substrate
60*d*: Connection region to circuit substrate
80: Connection substrate
80*a*: External connector (of connection substrate)
80*b*: Internal connector (of connection substrate)
82: Circuit substrate
84: Frame
90, 290: Casing
90*a*: Casing main body (of casing)
90*aa*: Opening (of casing)
90*ab*: Casing main body lower portion (of casing)
90*ac*: Side surface opening (of casing)
90*b*, 290*b*: Side plate (of casing)
290*ba*: Side plate base portion
290*bb*: Fin
92: Flexible substrate
94: Elastic plate
96: First heat insulating member
98: Second heat insulating member
S: Inclination portion

The invention claimed is:

1. A liquid discharge head comprising: a head main body; a casing; and one or more driver IC that drives the head main body, wherein the casing has an opening, and is bonded to the head main body at an edge of the opening so as to cover at least a part of the head main body, and a part of an inner surface of a side plate of the casing continuing from the opening has an inclination portion inclined toward the inner side of the casing with respect to the opening, and the driver IC is in contact with the inclination portion of the inner surface.

2. The liquid discharge head according to claim 1, wherein a part of an outer surface of the side plate placed on the opposite side of the inclination portion is inclined toward the inner side of the casing with respect to the opening.

3. The liquid discharge head according to claim 1, wherein the casing includes a casing main body provided along an end of the side plate.

4. The liquid discharge head according to claim 1, wherein the head main body is elongated in one direction, and the side plates respectively having the inclination portions are arranged to face each other along the one direction, and the driver ICs are respectively in contact with the inclination portions respectively of the side plates arranged to face each other.

5. The liquid discharge head according to claim 1, wherein the head main body is elongated in one direction, the side plate having the inclination portion in contact with the driver IC is arranged along the one direction, and the outer surface of the side plate placed on the opposite side of the inclination portion is substantially parallel to an outer surface of the other side plate along the one direction of the casing.

6. The liquid discharge head according to claim 1, wherein the head main body is elongated in one direction, the side plate having the inclination portion in contact with the driver IC is arranged along the one direction, the side plate has a plate shape side plate base portion in which one surface serves as the inner surface, and a plurality of fins extending from the side plate base portion toward the outer side of the casing, and leading ends of a plurality of the fins are substantially parallel to the outer surface of the other side plate along the one direction of the casing.

7. The liquid discharge head according to claim 1, wherein the driver IC is pushed onto the inclination portion by an elastic plate attached to the head main body, and in a state where the head main body and the casing are separated from each other, a part of the driver IC to be pushed onto the inclination portion is placed on the inner side of the casing with respect to the opening.

8. The liquid discharge head according to claim 1, wherein the driver IC is mounted on a flexible substrate electrically connected to the head main body, and the flexible substrate is in contact with the inner surface.

9. The liquid discharge head according to claim 8, wherein on the side of the head main body with respect to a part of the flexible substrate where the driver IC is mounted, the flexible substrate is in contact with the inner surface.

10. A recording device comprising: the liquid discharge head according to claim 1, a conveying section that conveys a recording medium to the liquid discharge head, and a control section that controls the head main body.

* * * * *